United States Patent [19]

Herten

[11] 4,386,514

[45] Jun. 7, 1983

[54] METHOD FORMING A DRAWN CONTAINER AND A CONTAINER PRODUCED BY THIS METHOD

[75] Inventor: Rolf Herten, Meerbusch, Fed. Rep. of Germany

[73] Assignee: Blechwarenfabrik Gustav Gruss & Co., Fed. Rep. of Germany

[21] Appl. No.: 167,005

[22] Filed: Jul. 9, 1980

[30] Foreign Application Priority Data

Jul. 10, 1979 [DE] Fed. Rep. of Germany ..... 2927755

[51] Int. Cl.[3] ..... B21D 22/06

[52] U.S. Cl. ..... 72/347; 72/350

[58] Field of Search ..... 72/347, 348, 349, 350

[56] References Cited

U.S. PATENT DOCUMENTS

| | | | |
|---|---|---|---|
| 3,302,441 | 2/1967 | Bozek | 72/348 |
| 3,768,295 | 10/1973 | Cudzik | 72/347 |
| 4,121,449 | 10/1978 | Celi | 72/350 |
| 4,193,285 | 3/1980 | Zunsteg | 72/348 |

*Primary Examiner*—Leon Gilden

*Attorney, Agent, or Firm*—Eyre, Mann, Lucas & Just

[57] ABSTRACT

The invention relates to a method for drawing a wrinkle-free thin-walled cup from a sheet blank, using a die formed as a draw ring, a holddown that holds the blank material against the draw ring, and a drawing punch, which pushes the blank into the opening of the draw ring, wherein the blank material that flows from the slot between the draw ring and the holddown is formed by drawing in an initial zone of deformation which surrounds the punch, and flows into the opening of the draw ring over the latter's inner edge which is adjacent to the area of the holddown.

According to the invention, in order to draw a conical cup of sheet metal, preferably of sheet steel, having a peripheral wall which forms with respect to the center axis of the cup an angle sheet is smaller than 60° and preferably an angle of 3°, utilizing a rigid construction of both the draw ring end of the holddown and the draw punch, the holddown subjects the blank material to a force that amounts to a multiple of the force of the draw punch, in such manner that the material which flows from the initial zone of deformation into the opening of the draw ring is formed in a second conic zone of deformation by means of stretch forming in a free cavity formed between the draw punch and draw ring.

8 Claims, 8 Drawing Figures

Figure 1A:
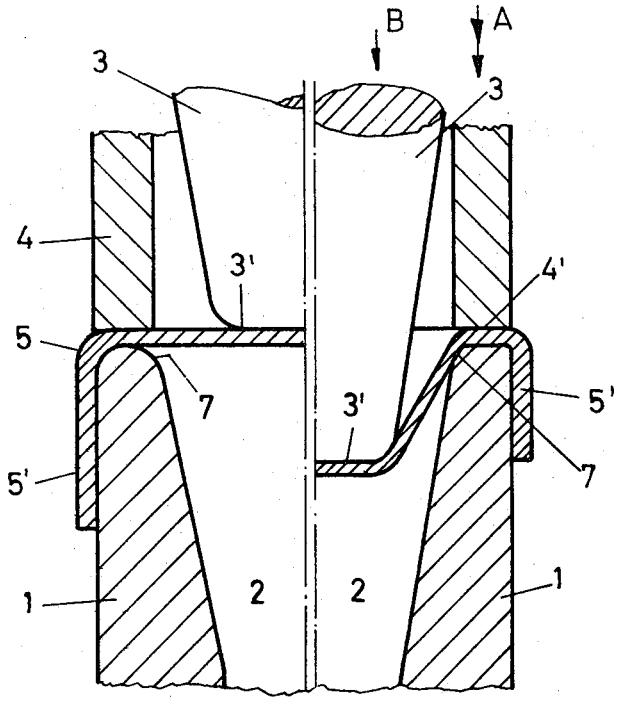

Fig.2
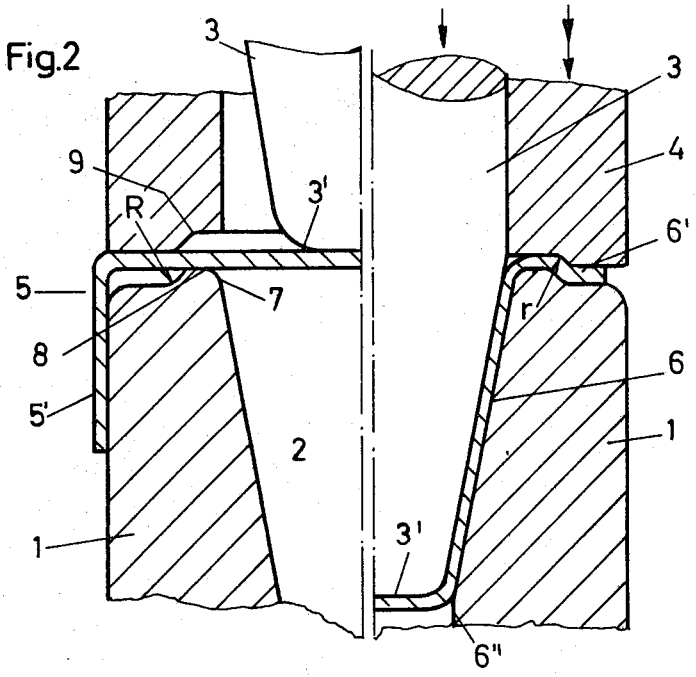
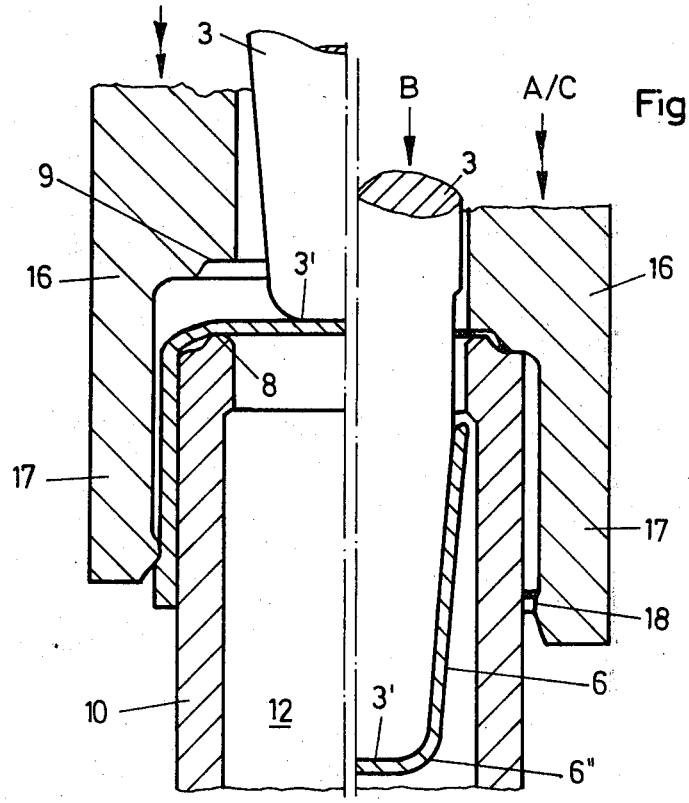
Fig.4

Measuring Point
Edge
Starting Material
Residual Flange
Circular Conical Embossing with Drawing-stretch Forming
Circular Conical Cup Wall
Bottom Radius
Bottom
Bottom Middle Point
Drawing Depth (mm)
Bottom Radius (mm)
Sheet-metal Thickness (mm)
0,28 0,29 0,30 0,31 0,32 0,33 0,34 0,35 0,36 0,37 0,38 0,39 0,40 0,41 0,42

METHOD FORMING A DRAWN CONTAINER AND A CONTAINER PRODUCED BY THIS METHOD

The invention concerns a method for drawing a wrinkle-free thin-walled cup or container from a sheet blank, using a die formed as a draw ring, a holddown or press that forces the blank material against the draw ring and a drawing punch, which forces the blank into the opening of the draw ring, wherein the blank material that flows from the slot between the draw ring and the holddown is formed by drawing in an initial zone of deformation which surrounds the punch, and flows into the opening of the draw ring over the latter's inner edge (draw-ring edge) which is immediately adjacent to the area of the holddown.

The invention further relates to an apparatus which preferably can be used to implement this method, as well as a cup or container that is produced in accordance with the method.

A very common and economical procedure for producing cups or containers consists of forming by means of deep drawing under tension/compression of a sheet-metal blank into a cup shape, and wherein the deep drawing occurs in a narrowly limited draw slot which is adapted to the thickness of the sheet-metal. The draw slot is formed at the very beginning of the drawing process, between the opening wall of the draw ring and the external circumferential surface of the draw punch that penetrates into the draw ring. If one takes into account and properly dimensions all drawing parameters, some of which mutually influence one another, such as, for instance, tensile and compressive forces, and if one properly designs the radius of the draw ring, over which radius the sheet-metal is pulled, into the draw slot at an unvarying angle of deflection of 90°, one obtains using this known process, cups having a purely circular cylindrical shape. In this known process the forming ends after the deflection of the material over the draw-ring radius.

However, if one attempts to use this drawing procedure with a deep-drawing tool adapted to the shape of the cup, for the purpose of producing cups or containers with a circular conical shape, considerable difficulties are encountered since, when producing circular conical cups, both the drawing punch and the opening of the draw ring must each be conical, there is produced at the beginning of the draw ring a correspondingly wide slot in the tool between the drawing punch and the draw ring. The requirement for this slot leads to a so-called "free material ring" with the blank or sheet-metal used, where the "free material ring" is not covered by the holddown. When drawing the sheet-metal into the tool space or into the opening of the draw ring, there are produced in the wall of the cup undesirable longitudinal wrinkles, i.e., so-called "wrinkles of the second kind," which cannot be removed, even in the closed position of the tool. Furthermore, as the drawing depth increases, there is also an increasing occurrence of material-dependent and tool-dependent earing in the flange area of the cup, which earing further promotes the deleterious formation of wrinkles, and which in addition causes an undesirable extra consumption of material.

A considerable difficulty involved in the forming of circular conical cup shapes thus consists, first of all, in that the sheet-metal to be formed, which as a rule is plane, cannot be held in a fully flat manner during the entire forming process, in a constrained conical guide within a deep-drawing tool that is adapted for the desired cup shape.

Furthermore, the deep-drawing procedure that is used to produce circular cylindrical cups may not be used without further adjustments to form cups with circular conical shape, for the reason below.

When deep-drawing a circular cylindrical cup shape, the forming of the sheet metal after flowing through the initial zone of deformation in the area of the holddown, or after the deflection over the inner edge of the draw ring, at a constant angle of deflection of 90°, is essentially finished as the sheet metal flows into the tight-tolerance draw slot. When using the known deep-drawing procedure to form circular conical cups, the forming of the cup is only completed gradually, because the angle of deflection of the sheet-metal over the inner edge of the draw ring at the draw-ring radius varies continuously, so that the draw-ring edge either cannot exert its function, or functions in only limited or belated fashion.

Furthermore, during the forming of the cup, its conical wall is subject over its entirety to constant reductions of diameter. The excess material then causes tangential compressive stresses in the sheet metal, stresses which cause in the cup wall being generated, the wrinkling of the second kind already mentioned before. These undesirable longitudinal wrinkles, which generally extend over the height of the cup wall and, in the shape of waves, over the periphery of the wall, can then no longer be removed, not even in the closed position of the tool, i.e., when the circular conical surfaces of the drawing punch and of the draw ring abut tightly against the cup wall.

To the tangential compressive stresses which result from the bulging process on the occasion of the diameter reductions during the circular conical wall formation, there are also added tangential residual compressive stresses from the slot in the area of the holddown, before the inner edge of the draw ring. As is known, the thickness of the sheet metal changes during the drawing process in part of the holddown area as well, or in a part of the slot between draw ring and holddown is determined by the greatest sheet-metal thickness, there finally occurs during the drawing process, at the inner margin of the holddown area which is adjacent to the opening of the draw ring, a region in which neither the holddown nor the draw ring press against the sheet-metal with sufficient force, which makes it possible for the sheet metal to buckle and to start the formation of "wrinkles of the first kind". These cannot be prevented during circular conical embossing, either by the normal holddown pressure or by the draw-ring radius due to the constantly changing angle of deflection; moreover, the formation of wrinkles of the first kind reinforces even more the tendency towards the formation of wrinkles of the second kind in the cup wall.

Therefore, since circular conical cups cannot be produced with ordinary deep-drawing processes, special processes or installations were developed for the forming of circular conical cups, which processes or installations were to prevent the undesirable formation of longitudinal wrinkles in the cup wall, during the drawing process.

The best known of these processes are the so-called stepwise drawing procedures (DE-OS No. 24 51 511), in which when a circular conical cup is drawn, first a blank consisting of a series of successive circular cylindrical sections is produced by means of deep drawing, and the blank is brought into its final circular conical shape by means of a special tool. In order to produce circular conical cups whose circumferential walls forms an angle smaller than 60°, with respect to the axis of the cup, two or more individual draws, depending on cup depth or drawing height, may be necessary in order to produce the blank with the circular cylindrical sections. These known step-wise drawing procedures require considerable tooling expenses.

Furthermore, there are known procedures (German Pat. No. 39 23 48, U.S. Pat. No. 3,302,441), in which the circular conical final shape is produced in a drawing tool. In these tools, the distance between holddown and drawing punch and/or between drawing punch and draw ring is kept small during the drawing procedure, by means of supplementary movable auxiliary tooling components, such as rings with conical surfaces that are under the action of springs. In this fashion, by using several small and consecutive individual drawing steps, better results, i.e., as wrinkle-free as possible conical cups, are achieved. These known procedures also require complicated tooling constructions and therefore high tooling costs.

The invention solves the problem in a process of the type described at the outset, for drawing thin-walled conical cups, which process avoids the disadvantages of known procedures or installations, and with which process it is possible to form from a blank, thin-walled conical containers, such as cans, essentially in one operating step, without the risk of wrinkle formation and with simple tool construction.

According to the invention, in order to draw a conical cup from sheet metal, particularly from sheet steel, a cup having a circumferential wall which forms, with respect to the center axis of the cup, an angle smaller than 60°, and preferably an angle of 3°, using a rigid construction both of the die and of the holddown and the draw punch, the holddown subjects the blank to a force that amounts to a multiple of the force of the draw punch, so that the material that flows from the first zone of deformation into the opening of the draw ring is formed in a free cavity by means of stretch forming, causing an increase in the surface of the sheet metal and a simultaneous decrease in the thickness of the sheet metal. This forming thus takes place in a second zone of deformation.

The second zone of deformation, in the procedure according to the invention, is located in the opening of the draw ring, i.e., in the area between the draw punch and the wall of the opening of the draw ring, wherein the width of this second zone of deformation, in a direction perpendicular to the axis of the draw punch, that is, perpendicular to the motion of the draw punch, is substantially greater than the thickness of the sheet metal, at least at the beginning of the deformation. At the beginning of the deformation, this distance from the bottom edge of the draw punch to the inner edge of the draw ring is roughly one half the difference between the maximum and the minimum diameters of the cup to be produced.

In the procedure according to the invention, the actual forming or embossing of the blank into the desired cup shape occurs in the second zone of deformation, by stretch forming of the sheet metal between the bottom edge of the draw punch and the inner edge of the draw ring, with increase in the surface of the sheet metal and with simultaneous decrease in the thickness of the sheet metal; such forming or embossing taking place in a totally free cavity, and specifically taking place without any supplementary auxiliary components against which the material of the blank could be supported, which material is continuously redrawn from the sliding clamp-fastening in the area of the holddown.

In the process according to the invention, "drawing in the first zone of deformation" means that the material of the blank is subjected to such a forceful clamp-fastening, e.g., by the holddown, that said material may be able to flow, based on the effect of the draw punch, into the first zone of deformation, i.e., into the holddown area, radially inward, but that in so doing the material is subjected to radial tensile stresses.

The "rigid design of the die, the holddown and the draw punch" means, in the procedure according to the invention, first of all that each of these tool parts do not consist of several individual parts of auxiliary components that are movable in relation to one another, but preferably also means that specifically the holddown does not feature flexible means such as for example springs, which means prevent or could inhibit the force exerted by the holddown upon the blank, for the purpose of clamp-fastening the blank in the area of the holddown, from exceeding the force of the draw punch by a multiple.

The "stretch forming in the second zone of deformation" means, in the case of the procedure according to the invention, first of all that the material that flows into the second zone of deformation undergoes a stretching during the embossing due to the clamp-fastening in this second zone of deformation. In a preferred embodiment of the invention this stretching, referred to the material of the blank, is in the vicinity of 30%.

In contrast to ordinary stretch forming, in which the blank is clamp-fastened between the tool parts in an undisplaceably rigid manner, in the case of the procedure according to the invention the drawing of the cup thus occurs from a clamp-fastening in the first zone of deformation, which clamp-fastening while indeed extremely frictional and non-positive, is however only a little sliding in nature. This increased clamp-fastening results in the deformation of the blank by means of drawing-stretch forming into the conical shape of a cup.

The clamp-fastening of the blank that is required for such drawing-stretch forming occurs in the procedure according to the invention preferably in the slot formed between the holddown and the draw ring. The clamp-fastening force on the blank which is required for such drawing-stretch forming, may, for instance, be achieved by means of a greatly increased adjustable holddown force, which force exceeds by a multiple the force of the draw punch. In order to exert this force upon the sheet metal flowing through in a more effective and also a more controllable manner and in order to thus maintain the clamp-fastening of the sheet metal in an even more forceful manner, it may, for instance, be practical to design the surface of the holddown and the corresponding surface of the draw ring which act upon the blank in a manner such, that the slot between the holddown and draw ring displays an annular section that is decreased by several hundredths of a millimeter, which section is then located preferably at the inner margin of the holddown area which is in the vicinity of the draw-ring opening or of the draw-ring edge (slot between holddown and draw ring). By means of this narrowed region of the slot, an extremely high specific surface pressure is exerted upon the sheet metal flowing through, whereby this sheet metal thus simultaneously undergoes a certain drawing.

The extremely high holding force or clamp-fastening force that is exerted upon the sheet metal flowing through is a precondition for producing, in the sheet metal, radial tensile stresses that are sufficient for the drawing-stretch forming, by means of which tensile stresses the tangential compressive stresses that are produced during the conical forming, due to the reduction in diameter, are transformed into tangential tensile stresses, whereby the "wrinkle formation of the second kind" that is caused by the excess of material, is eliminated.

The conical forming in the procedure according to the invention occurs with constant changes in the angle of inclination of the cup wall, as well as under constant reduction of the diameter of the entire wall surface being generated, and occurs without any constraint by means of a positive support, or occurs without resorting to any other supplementary auxiliary tooling components. With the increase in the surface of the sheet metal and with the simultaneous decrease in the thickness of the sheet metal that occurs in this embossing, there also occurs a corresponding, increasing work hardening of the material, which acts in a stabilizing fashion on the conical forming.

In the procedure according to the invention there occurs a change in the thickness of the sheet metal, which change takes a form such that the cup produced has a sheet-metal thickness that changes, starting from the center of the bottom of the cup, radially outward and along a generatrix of the cup from the bottom to the upper edge of the opening, according to a curve or reduction curve which in its shape roughly resembles a sickle. In the area of the bottom, the thickness of the sheet metal is substantially constant, but is clearly below the sheet-metal thickness of the starting material or of the blank utilized. In the wall area, the sheet-metal thickness first decreases in the direction "cup bottom-cup opening", and then again increases, with the sheet-metal thickness at the upper edge of the cup approaching the sheet-metal thickness of the starting material, or with the sheet-metal thickness of the residual flange lying significantly above the sheet-metal thickness of the starting material. The maximum decrease in the sheet-metal occurs in cups produced according to the procedure of the invention, at the transition from the lower to the middle third of the height of the cup wall. The hardness curve shows similar variations, but mirror-image fashion, with the proviso however that the curve lies totally above the hardness of the starting material.

Since in the procedure according to the invention high compressive forces must be exerted upon the blank in order to achieve the drawing-stretch forming, and since therefore friction forces that are correspondingly high occur at the sheet metal, it is practical in the procedure according to the invention to provide appropriate lubrication, in order to prevent tearing of the sheet metal during drawing through. For the purpose of such lubrication, both surface sides of the sheet-metal blank may be coated, for instance, with a drawing lacquer based on phenol-epoxy resin. Such a coating, which may have a thickness of only a few thousandths of a millimeter, and which may be applied in a very uniform manner, is particularly advantageous as a means of lubrication, since the coating is firmly anchored to the sheet metal and is furthermore extremely elastic.

In a preferred embodiment of the procedure according to the invention, a circular cylindrical cup is used as a blank, the diameter of the cup being slightly larger than the maximum diameter of the circular conical cup that is to be produced. This circular cylindrical blank is then formed into the cup shape desired, either by redrawing or, preferably, be reverse drawing, utilizing the special characteristics of the invention. When so doing, the first zone of deformation lies in the bottom area of the circular cylindrical blank.

In the procedure according to the invention, the pressure of the holddown is preferably about 2 to 3 times the pressure of the drawing punch.

The installation preferably used to carry out the procedure according to the invention, with a rigid construction of draw ring, drawing punch, and holddown, there is provided at least one drawing slot which lies concentrically to the axis of the drawing punch and outside the opening of the draw ring, through which slot the material of the blank flows to the draw ring, while being formed by means of drawing or by modified drawing.

In the installation according to the invention, the drawing slot may, for instance, be formed between the front surface of the holddown and the front surface of the draw ring. It is, however, also possible to provide, either instead of said drawing slot or in addition to it, a drawing slot that surrounds the draw ring or, instead, the holddown. In either case, there occurs by means of said drawing slot a diminution of the thickness of the sheet metal in the wall of the blank, which blank may feature, for instance, the shape of a circular cylindrical cup. The blank may be formed into the desired circular cup shape both by reverse redrawing and by direct redrawing.

The procedure according to the invention as well as the installation according to the invention distinguish themselves by a particularly simple design of the tooling as well as by optimum utilization of material. The circular conical cups produced with the procedure according to the invention or with the installation according to the invention are free of undesired wrinkles.

Figure 1B:
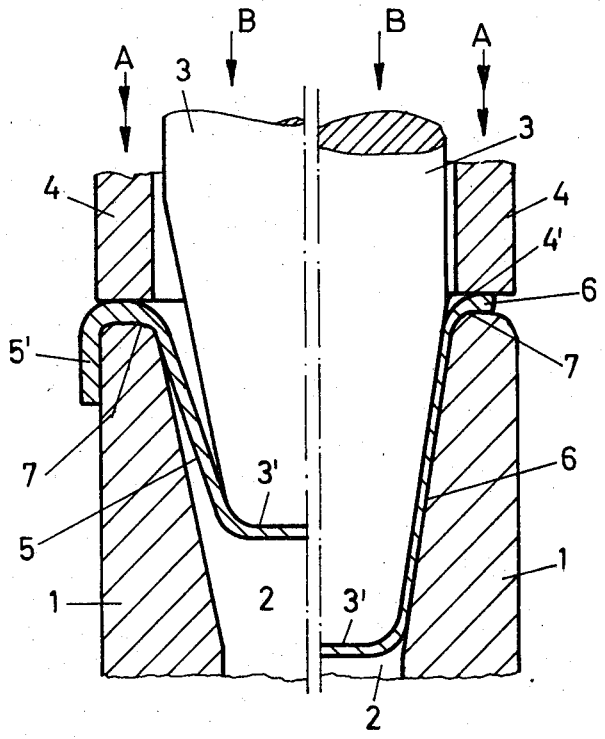
Figure 3A:
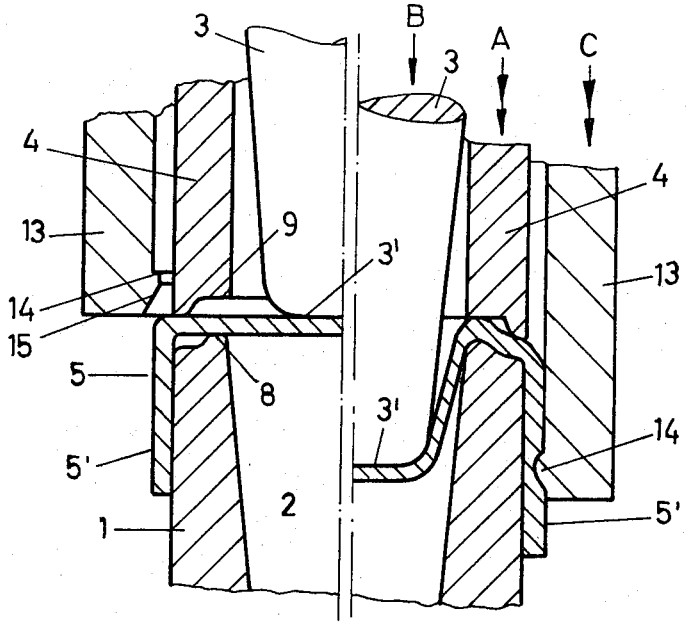
Figure 3B:
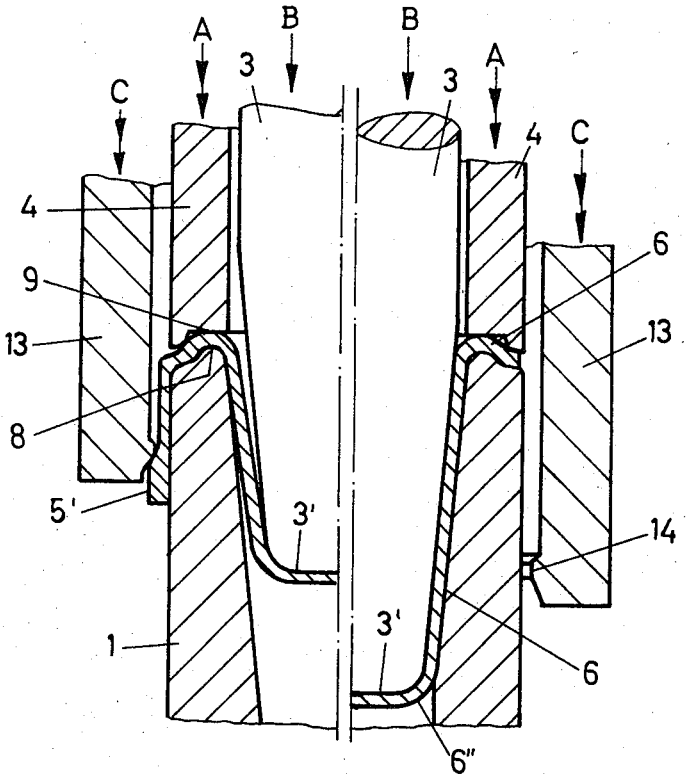
Figure 5:
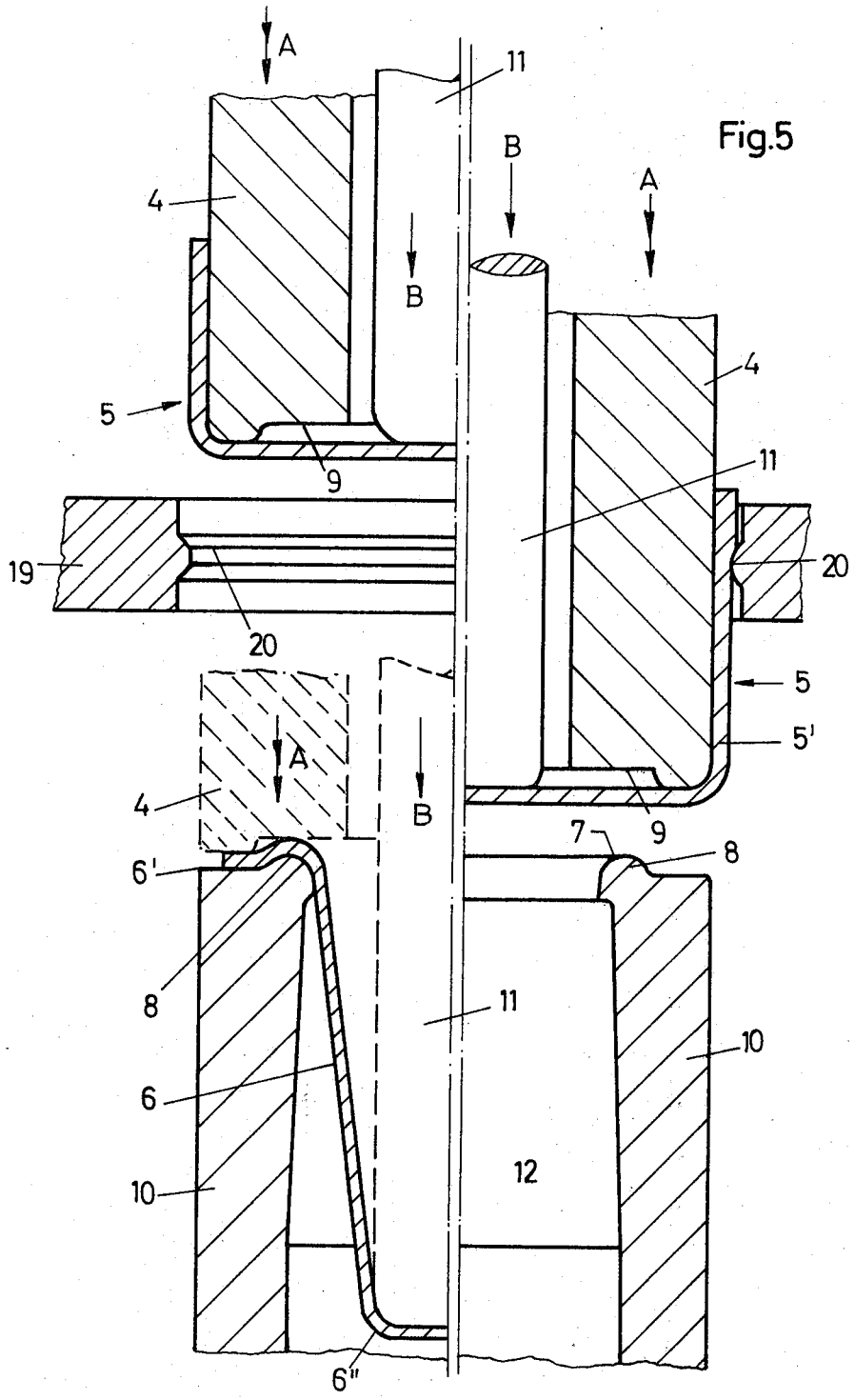
Figure 6:
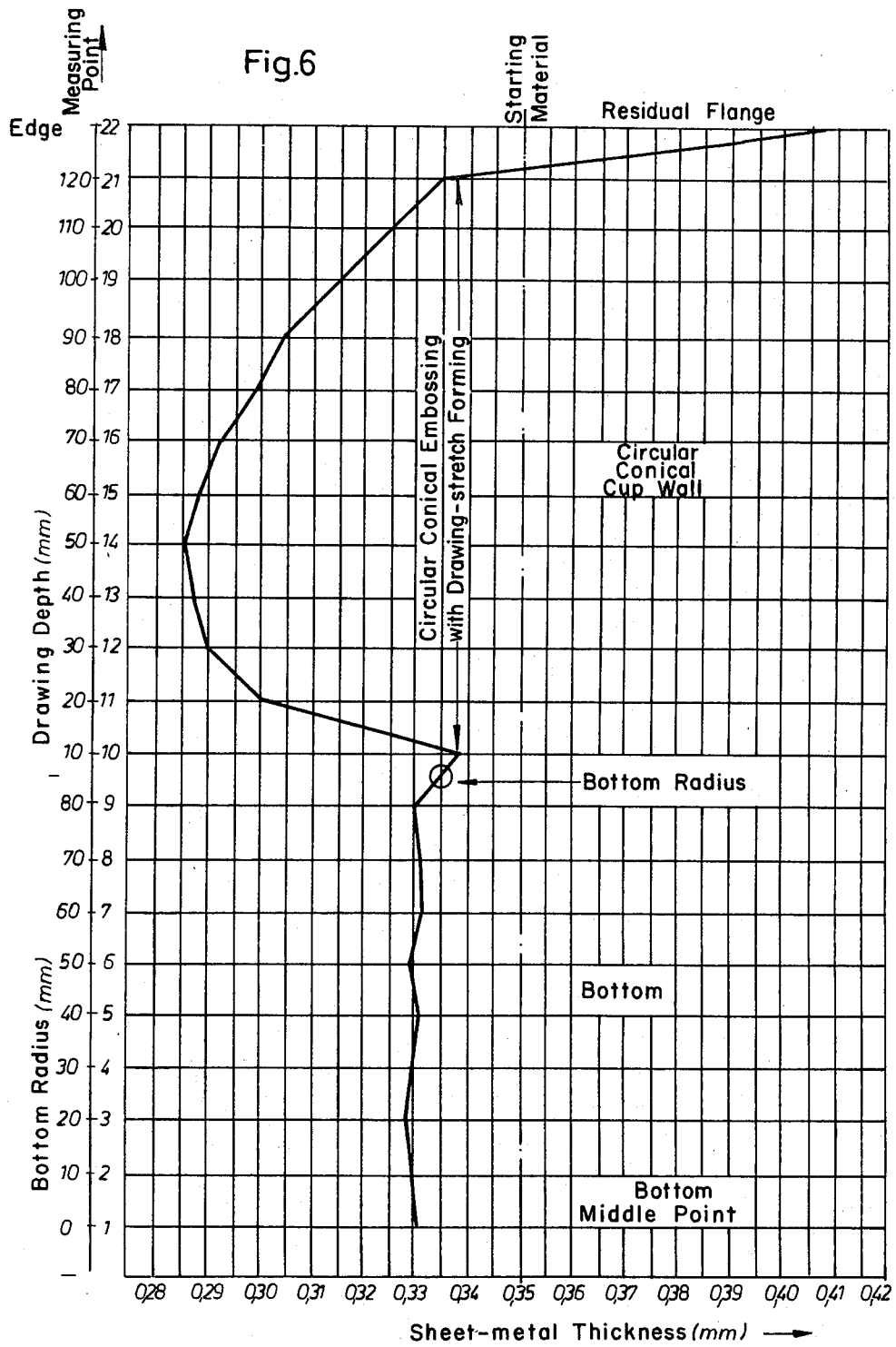

Below, the invention is more clearly explained by means of the figures, using examples of embodiment. The figures show the following:

FIGS. 1*a* and 1*b*, in schematic representation, the draw ring, the holddown, the drawing punch, as well as the sheet-metal blank or the finished cup, in various stages of the forming process, with an initial form of embodiment of the procedure according to the invention or the installation according to the invention;

FIG. 2, is a representation similar to that of FIG. 1, however, with a modified design of the draw ring, as well as of the holddown that works together with the draw ring;

FIGS. 3*a* and 3*b*, a representation similar to that of FIG. 1, in which a draw ring that causes an additional drawing of the material is provided, in addition to the draw-ring, holddown, and drawing punch;

FIG. 4, a modification of the tool according to FIG. 3, wherein the holddown and the draw ring are combined into a single part;

FIG 5, a modification of the tool according to FIG. 3, in which the draw ring is held in stationary fashion, and drawing punch and holddown are movable;

FIG. 6, a graphic representation which shows the changes in the wall thickness of a cup produced with the procedure according to the invention.

FIGS. 1*a* and 1*b* show a sectional view of a draw ring 1 which has an inner opening 2 that conically narrows in a downward direction. In this opening 2, a drawing punch 3 may be inserted from above, which drawing punch also narrows in cone or cone-frustum fashion, in the direction towards its bottom surface 3'. The inner wall of opening 2 and the cone-frustum shaped outer surface wall of drawing punch 3 are adjusted to one another in a manner such that both feature the same inclination in relation to the axis of drawing punch 3 or opening 2. Consequently to the drawing punch there is a holddown 4 in the shape of a ring; this holddown, which, like drawing punch 3 is movable upward and away in relation to the drawing ring, can be brought with its bottom front side 4' to abut against the upper margin of draw ring 1 or with the cup side of the blank 5 that lies on the upper margin of draw ring 1. Blank 5, which is made of sheet metal, features, in the embodiment shown, the shape of a shallow (low) circular cylindrical cup. The diameter of this circular cylindrical cup is greater than the maximum diameter of the finished circular conical cup 6; furthermore, the inside diameter of blank 5 is selected in a manner such that this blank abuts with its cylindrical peripheral wall 5' against the outer peripheral wall of the draw ring. The peripheral wall 5' extends from the upper margin of draw ring 1 in a downward direction.

FIG. 1*a* shows, left, the starting shape which the tool parts and the blank display at the beginning of the drawing process. At the beginning of the drawing process first the holddown is pressed as shown by arrow A with its lower front surface 4' against the bottom of the circular cylindrical blank 5, whereby the blank is clamp-fastened in the outer bottom region between the lower front surface 4' of holddown 4 and the upper margin of draw ring 1. In so doing, the clamp-fastening, however, occurs in a manner such, or with a force such, that when drawing punch 3 moves downward in the direction of arrow B, the material of the blank is pulled, under drawing in the slot between holddown 4 and draw ring 1, over the inner edge 7 of draw ring 1, into opening 2 of said draw ring. In this manner, there first occurs a pre-forming of the material in the area of the holddown, i.e., in the area of the slot between holddown 4 and draw ring 1, by means of drawing, while the final embossing occurs by drawing-stretch forming of blank 5, with increase in the surface of the sheet metal and with simultaneous decrease of the thickness of the sheet metal, in the opening 2 of draw ring 1, or in the region between the inner wall of said opening and the drawing punch, as well as in the region of bottom surface 3' of the drawing punch. FIGS. 1*a* and 1*b* show right and left, respectively, the variation in the intermediate shapes which the components of the tool as well as blank 5 feature during drawing or during the penetration of drawing punch 3 into draw ring 1, until drawing punch 3 has penetrated completely into the opening 2 of draw ring 1 and until the tool components thus display the final position shown in FIG. 1*b*, right of the center line. In this final position, drawing punch 3 lies with its cone-frustum shaped outer surface against the inner surface of the finished cup 6, while the outer surface of the cup abuts against the wall of opening 2.

After the completed production of cup 6, drawing punch 3 as well as holddown 4 are pulled back, so that cup 6 may then be removed from draw ring 1.

FIGS. 1*a* and 1*b* also show in particular that the actual embossing of blank 5 into cup 6 occurs in a free cavity between drawing punch 3 and draw ring 1, without constraint guiding of the material, and that, furthermore, the angle that the conical peripheral wall of the blank forms during the drawing process with the axis of drawing punch 3 or with the axis of symmetry of the finished cup 6, changes constantly. Furthermore, FIGS. 1*a* and 1*b* show that the material of blank 5 or the material of the cylindrical peripheral wall 5' of said blank continuously flows, during the embossing of cup 6, through the slot between holddown 4 and draw ring 1. Furthermore, it may be seen in FIGS. 1*a* and 1*b* that the embossing of cup 6 from blank 5 occurs in a manner such that it may also be described as "reverse redrawing" i.e., during the drawing or embossing, the bottom surface of the circular cylindrical blank 5 is pushed inward, i.e., into the space enclosed by peripheral wall 5', by the drawing punch 3.

Even though the drawing tool consists, in the embodiment shown in FIGS. 1*a* and 1*b*, of a draw ring with a conical opening and of a draw punch with the conical outer surface, it also would be possible, using the process described, to use a draw punch with a circular cylindrical outer surface and with a diameter that is equivalent to the smallest diameter of cup 6 or to the diameter of the closed bottom of cup 6. In principle, it would also be possible to use, instead of a draw ring with an opening that narrows conically in a downward direction, a draw ring whose opening features a diameter that is essentially constant over the entire height of the draw ring.

FIG. 2 shows a sectional view of an installation or a drawing tool for the drawing of cup 6 from blank 5, wherein said drawing tool again consists of draw ring 1, of draw punch 3, as well as of ring-shaped holddown 4. In FIG. 2, left of the center axis of the axis of symmetry, there are again shown the starting shape, i.e., that state which the parts assume at the beginning of the drawing process, while right of the center line there is described the final shape or the state which the parts assume at the end of the drawing process.

So far as concerns the shape of blank 5, the design of drawing punch 3 as well as opening 2 in draw ring 1, there are no differences relative to the form of embodiment according to FIGS. 1*a* and 1*b*. It is true that, in the tool represented in FIG. 2, the lower front surface of holddown 4, as well as the upper front surface of the draw ring are not plane, but are designed in stepwise fashion, namely in a manner such that at the inner edge 7 of opening 2 there is provided an annular bead 8 that protrudes beyond the upper front surface, to which is matched at the lower front surface of ring-shaped holddown 4 a ring-shaped recess 9. The height of annular bear 8 and/or the depth of the ring-shaped recess 9 are selected in a manner such that with holddown 4 pressed against blank 5, the width of the slot between holddown 4 and the draw ring, laterally from the annular bead or the ring-shaped recess, is equivalent to the thickness of the material of blank 5, while the width of the slot between holddown 4 and draw ring 1 in the area of annular bead 8 or in the area of ring-shaped recess 9, is slightly smaller than the thickness of the material of blank 5. With holddown 5 pressed down, there thus is produced by annular bead 8, between said holddown and draw ring 1, an annular line-shaped slot or pressing slot that narrows radially inward, i.e., in the direction of opening 2, which slot materially promotes the pressing of the material in the area of the holddown, i.e., in the area between draw ring and holddown, which pressing distinguishes the procedure according to the invention, or which slot permits said pressing, in the case of a pressing force that is diminished by comparison to form of implementation according to FIGS. 1*l* and 1*b*.

As FIG. 2 furthermore shows, the slot forms a route that is roughly S-shaped in section, between draw ring 1 and holddown 4 through annular bead 8 or through the ring-shaped recess. This means that at the beginning of the drawing process or upon pressing holddown 4 against blank 5, the bottom of the blank is formed, at least in a partial region, in a so-called "abbreviated first draw" in an upward direction, that is, in a direction opposite to the direction of the action of draw punch 3.

Again, in the form of embodiment shown in FIG. 2, the embossing of blank 5 into cup 6 is finished when the outer surface of draw punch 3 abuts against the inner surface, and the peripheral wall of opening 2 abuts against the outer surface of finished cup 6. In the slot between holddown 4 and draw ring 1, there remains, after cup 6 has been completely drawn, a so-called residual flange 6'.

As also shown in FIG. 2, the ring-shaped recess 9 has a plane bottom surface; the ring-shaped recess 9 is open towards the inner surface of holddown 4 which is in the vicinity of draw punch 3. Annular bead 8 is placed in the immediate proximity of the inner edge 7 of the draw ring, or in the immediate proximity of opening 2 of draw ring 1. Since the height of annular bead 8 is slightly larger than the depth of the pertinent ring-shaped recess 9, if blank 5 is missing and if holddown 4 abuts against draw ring 1 or holddown 4 abuts with the bottom of recess 9 against annular bead 8, there remains a slot in the area outside of annular bead 8, between holddown 4 and draw ring 1. The substantially plane bottom surface of recess 9 forms with the axis of the draw punch an angle of preferably about 90°. The front surfaces of draw ring 1 and of holddown 4 are respectively crowned, in the area of transition to annular bead 8 and in the area of transition to recess 9. The crown in the area of transition to annular bead 8 has a radius of curvature R which is greater than the radius of curvature r of the crown in the area of transition to the ring-shaped recess 9.

FIGS. 3*a* and 3*b* show a further construct of the tool in accordance with FIG. 2, in various working stages, as follows: in FIGS. 3*a*, left of the center axis in the initial shape, and in FIG. 4*b* right of the center axis in the final shape, while in FIGS. 3*a* and 3*b*, right of the center line and left of the center line there are illustrated, respectively, two intermediate shapes.

The tool represented in FIGS. 3*a* and 3*b* is equivalent to the tool in accordance with FIG. 2, so far as concerns the geometric design of draw ring 1, of draw punch 3, and of holddown 4; however, the tool according to FIGS. 3*a* and 3*b* also features, in addition to these tool parts a drawing ring 13, which is placed concentrically to draw punch 3 and to holddown 4, and which surrounds the latter. Drawing ring 13, can be shifted axially downward, according to arrow C, from an initial position in which the lower ring-shaped front edge of drawing ring 13 lies above the upper ring-shaped front edge of draw ring 1, to a lower end position, in which the lower front edge of drawing ring 13 is located laterally from the peripheral wall of draw ring 1. The otherwise circular cylindrical-shaped or sleeve-shaped drawing ring 13 has in the vicinity of its lower front edge an annular bead 14 that protrudes into the inner space of the ring, which bead features a flank 15 that runs towards the lower front side in a direction that is slanted towards the axis of drawing ring 13. The inside diameter of drawing ring 13 is selected in a manner such that, when drawing ring 13 is pushed down, the distance between bead 14 and the outer surface of draw ring 1 is smaller than the thickness of the material of blank 5.

By moving the drawing ring 13 in the direction of arrow C, there occurs before or simultaneously with, the embossing, an additional drawing of the material of blank 5, in the area of peripheral wall 5'. Thereby, a circular conical cup 6 may be produced, which cup features a very thin wall, even though what is used as blank 5 is a shallowly pre-drawn, relatively thick-walled cup.

While in the tool according to FIGS. 3*a* and 3*b*, the additional drawing of the material occurs through a drawing ring 13, which drawing ring is movable in relation to the remaining parts of the tool, FIG. 4 shows an embodiment of a drawing tool in which the ring-shaped holddown 16 features at its lower edge a projection 17 which surrounds the peripheral surface of draw ring 10 in ring-shaped fashion, and which forms, between its annular bead 18 and the peripheral wall of draw ring 10, a drawing slot. Drawing punch 3 once again has in this mode of implementation a cone-frustum-shaped outer surface, while draw ring 10 has a circular cylindrical opening 12.

In the case of the tools shown in FIGS. 3 and 4, in which there is an additional drawing of blank 5 by means of drawing ring 13 or by means of extension 17, it may be practical to design the tool parts in a manner such that annular bead 8 and ring-shaped recess 9 on the draw ring or on the holddown, respectively, are dispensed with, whereby the first draw described above does not occur. The front surface of the draw ring is in this case preferably crowned in semi-circular fashion, while the holddown is designed with a plane front surface.

In the case of the tools illustrated in FIGS. 3 and 4, the control of the tools may furthermore be effected in a manner such that holddown 4 or 16 is only definitively pressed against the blank, when draw punch 3 already partially moved into opening 2 or 12 of draw ring 10 or 1. In this first stage, the material of blank is held by drawing ring 13 that already moved downward, or by extension 17.

For the purpose of speeding the ejection of the finished cup 6 from the drawing press or from the tool, the draw ring 10 with circular cylindrical opening 12 is particularly appropriate. In this case, the finished cup 6, in the absence of residual flange 6', can be ejected by draw punch 3, immediately after the drawing procedure, through the lower, open end of draw ring 10 (FIG. 4). This accelerated ejection of the finished cup 6 is possible because, in the procedure according to the invention, no positive locking guiding of the material during drawing is required, and consequently a draw ring 10 with circular cylindrical opening 12 can be used.

In the forms of implementation described so far, draw punch 3, holddown 4 or 16 and the drawing ring 13 that may be provided are movable in relation to the draw ring. However, it is also possible to imagine installations in which other tool components are arranged in a stationary manner or are movable.

FIG. 5 shows a tool which consists of the stationary draw ring 10 and of the circular cylindrical draw punch 11 that van be moved in a lengthwise direction. Furthermore, the tool has ring-shaped holddown 4. While draw punch 11 and holddown 4 are moved downward in the direction of arrow A, or B, while forming blank 5 into circular conical cup 6, i.e., a movement in the direction of the axis of draw punch 11, the tool shown in FIG. 7 has a drawing ring 19, which is arranged in stationary fashion concentrically with the axis of draw punch 11. This drawing ring 19 is located above the upper front side of draw ring 10, yet underneath holddown 4 or draw punch 11, whenever these parts are located in their starting position indicated in FIG. 7, top left. The diameter of the opening of drawing ring 19 is selected in a manner such that an annular bead 20 provided on the wall of this opening forms a ring-shaped ironing slot with the cylindrical peripheral surface of holddown 4.

As can be furthermore seen in FIG. 7, blank 5, which again has the shape of a circular cylindrical cup, is inserted in the tool in a manner such that peripheral wall 5' of the blank is directed upward, i.e., in contrast to FIGS. 1–4, the blank 5 is formed in this mode of implementation not in reverse redrawing, but in direct redrawing into circular cup 6.

The operation of the tool described in FIG. 5, is as follows:

In an initial stage, draw punch 11 and holddown 4 which carries blank 5 move jointly downward, in the direction of arrows A and B, with holddown 4 and draw punch 11 moving through the opening of drawing ring 19. In the drawing slot formed between the peripheral surface of holddown 4 and the annular bead 20, there occurs a drawing of the material of peripheral wall 5' of blank 5. This initial stage is substantially concluded when the bottom of cup-shaped blank 5 comes to abut against the draw ring or against the bead 8. By further down-pressing of holddown 4, there then occurs at the bottom of blank 5, first a short first-draw in an upward direction, while simultaneously or immediately thereafter draw punch 11, with holddown 4 abutting firmly against the blank, is further pressed downward in the direction of arrow B, whereby the forming of blank 5 into cup 6 transpires. The forming process is concluded when drawing punch 11 is in the end position illustrated in FIG. 5, left of the center line, in broken lines.

The one-piece conical cups 6 produced by the procedure according to the invention may be used preferably as a packing material for mass-produced goods, or as containers or cans for the packing of goods at atmospheric pressure, or under vacuum, or positive pressure. The cups 6 may be particularly advantageously nestled, in a deep and therefore space-saving manner, which results in low storage and transportation volumes.

FIG. 6 shows the characteristic changes in the wall thickness of a conical cup 6, which are produced by the procedure according to the invention without additional drawing by means of an additional drawing ring. In FIG. 6, the abscissa represents the respective wall or sheet-metal thickness of the conical cup 6, and the ordinate the distance of a specific point measured from the center of the bottom or from the margin of the bottom of the finished cup. In the case of FIG. 6, it is further assumed that the starting material or blank 5 was sheet-metal of 0.35 mm. thickness.

Furthermore, as shown in FIG. 6, cup 6 has in its bottom part, that is along a radial line that starts at the center of the bottom, a substantially uniform sheet-metal thickness, of approximately 0.33 mm, i.e., about 94% of the sheet-metal thickness of the starting material. In the area of the bottom radius or in the area of transition point 6'', between the bottom and the peripheral wall of the cup, the sheet-metal thickness rises to 0.34 mm, i.e., to about 97% of the original sheet-metal thickness; the maximum sheet-metal thickness of 0.34 mm is reached in the area of about a cup height of 10 mm, which, when referred to the total height of the cup which is 120 mm. is equivalent to a standard cup height of about 8%.

Immediately thereafter, the wall thickness or the sheet-metal thickness decreases in the direction towards the upper cup margin, with the minimum of the sheet-metal thickness of 0.285 mm, reached at a cup height of 50 mm, or at a standardized cup height of 41%. This minimum is thus located at about the transition point between the first and the second third of the cup height.

Immediately thereafter, the wall or sheet-metal thickness again rises and, at the upper margin of the cup, approximates 0.35 mm. At a cup height of 120 mm, the wall or sheet-metal thickness amounts to 0.335 mm, or 95.7% of the sheet-metal thickness of the starting material. In the area of the residual flange 6', the sheet-metal thickness rises in linear fashion, and reaches a value of 0.41 mm, i.e., 117% of the sheet-metal thickness of the starting material.

The sickle-shaped curve represented in FIG. 6 is typical for the circular conical cups produced by the procedure according to the invention.

It will be understood that it is intended to cover all changes and modifications of the preferred embodiments of the invention herein chosen for the purpose of illustration which do not constitute departure from the spirit and scope of the invention.

In the installation according to the invention, as illustrated, for instance, in FIGS. 4 and 5, it is particularly advantageous to design opening 12 in draw ring 10 in a manner such that said opening slightly widens towards the side of draw ring 10 that is turned away from holddown 4 or 16, in a manner such that the finished cup may be very easily ejected downward, without interference.

Since the construction of drawing presses and the control of such drawing presses is generally known, FIGS. 1–5 only represent, respectively, the tool parts (draw ring, holddown, and draw punch) which are characteristic of the procedure according to the invention. These tool parts may be used with ordinary mechanical or hydraulic presses.

It is furthermore understood that the "initial stages" or "initial shapes" represented in FIGS. 1 to 5, show that state of the tool parts which they assume shortly before the embossing. In order to insert the blank or in order to remove the finished cup into or from the installation, the tool parts are naturally moved further apart.

What is claimed is:

1. A method for drawing a substantially wrinkle-free thin-walled conical cup from a steel blank using a draw ring, a holddown for holding said steel blank against the draw ring, said holddown and said draw ring forming between themselves a drawing slot and a draw punch for pushing the blank through a cavity of said draw ring, comprising the steps of:

(a) holding a steel blank between said holddown and said draw ring by using a predetermined clamping force; and (b) pushing said steel blank through said cavity of said draw ring using a force of said draw punch less than said predetermined force while clamping said blank, whereby said blank is stretch formed by the tension between said draw ring and an end of said draw punch as said blank is being drawn into said cavity through said drawing slot.

2. A method according to claim 1, wherein during step (b) the material of the blank undergoes a stretching of approximately 30% as referred to the starting material of the blank.

3. The method according to claim 1, wherein the material of the blank is drawn through a slot, which is formed between the draw punch and the holddown and the width of which decreases in direction of the flow of the material or in direction to the opening of the draw ring, respectively.

4. The method according to claim 1, wherein the material of the blank is drawn through a slot, which is formed between the draw punch and the holddown and is approximately S-shaped.

5. The method according to claim 1 wherein the material of the blank, has the shape of a circular cylindrical cup with a diameter that is larger than the maximum diameter of the conical cup to be produced.

6. The method according to claim 1 wherein the peripheral wall of the finished cup makes an angle smaller than 60° with respect to the center axis of the cup.

7. The method according to claim 6 wherein said angle is approximately 3°.

8. A method according to claim 1 wherein the material of the blank is coated on both surface sides with a well-adhering, mechanically resistant and elastic drawing lacquer.

* * * * *